US006017278A

United States Patent [19]

Benko

[11] Patent Number: 6,017,278

[45] Date of Patent: Jan. 25, 2000

[54] BOWLING GAME USING SETS OF PREDETERMINED PIN FALL OBJECTIVES

[76] Inventor: John Benko, 13500 Copper Bed Rd., Herndon, Va. 20171

[21] Appl. No.: 08/873,338

[22] Filed: Jun. 11, 1997

[51] Int. Cl.[7] ..... A63B 71/06

[52] U.S. Cl. ..... 473/70; 473/54; 473/64; 340/323 B

[58] Field of Search ..... 473/54–57, 64–71; 364/410.1, 411.1; 340/323 B; 273/269

[56] References Cited

U.S. PATENT DOCUMENTS

| | | | |
|---|---|---|---|
| 4,136,870 | 1/1979 | Kinser . | |
| 4,323,240 | 4/1982 | Stewart et al. . | |
| 4,787,634 | 11/1988 | Gautraud . | |
| 4,798,387 | 1/1989 | Richardson | 273/269 |
| 4,817,945 | 4/1989 | Ferguson . | |
| 4,834,381 | 5/1989 | Brim . | |
| 4,883,636 | 11/1989 | Fantle, Jr. . | |
| 4,930,775 | 6/1990 | Hoffman . | |
| 5,101,354 | 3/1992 | Mowers et al. . | |
| 5,118,105 | 6/1992 | Brim et al. . | |
| 5,165,693 | 11/1992 | Handlon, Sr. . | |
| 5,241,379 | 8/1993 | Tsujita | 340/323 B |
| 5,255,185 | 10/1993 | Mowers et al. . | |
| 5,450,318 | 9/1995 | Mowers et al. . | |
| 5,577,971 | 11/1996 | File . | |
| 5,582,549 | 12/1996 | File . | |
| 5,626,523 | 5/1997 | Mowers et al. . | |
| 5,628,692 | 5/1997 | Mowers et al. . | |
| 5,628,693 | 5/1997 | Mowers et al. . | |

OTHER PUBLICATIONS

YABA Coach/Instructor Manual, "Bowling skill development activities," p. 9–3, ©1987 by YABA.

*Primary Examiner*—Jessica J. Harrison
*Assistant Examiner*—Sheila Clayton
*Attorney, Agent, or Firm*—Nixon & Vanderhye P.C.

[57] ABSTRACT

A new bowling game has as its objective, to knock down sets of predetermined pin fall objectives. Each pin fall objective may comprise first and second pin fall counts. Score grids may be used to keep track of game objectives and results. Computer control and coordination may be used to achieve higher efficiencies and degrees of automation. The family of bowling games provided by this invention are games of skill that are fun and exciting to play, provide frequent winners, allow less experienced bowlers to win even when they play against more experienced bowlers, and provide strategic decisions and interest. The games are compatible with bowling lane equipment operating based on standard bowling 2-ball frames.

38 Claims, 15 Drawing Sheets

*Fig. 4A*

30

Bowler Name John Benko

Game # 7

22(1) GAME 1

| | | |
|---|---|---|
| 6/ | 81 | 8/ |
| 61 | 62 | 63 |
| 8/ | 71 | 72 |

22(2) GAME 2

| | | |
|---|---|---|
| 81 | 8/ | X |
| 9/ | 62 | 6/ |
| 72 | 71 | 7/ |

22(3) GAME 3

| | | |
|---|---|---|
| 6/ | 81 | 63 |
| 61 | X | 72 |
| 7/ | 9/ | 71 |

22(4) GAME 4

| | | |
|---|---|---|
| 63 | 62 | 7/ |
| 81 | 71 | X |
| 9/ | 8/ | 72 |

22(5) GAME 5

| | | |
|---|---|---|
| 72 | 62 | 81 |
| 8/ | 71 | 7/ |
| X | 9/ | 61 |

22(6) GAME 6

| | | |
|---|---|---|
| 71 | 62 | X |
| 6/ | 7/ | 81 |
| 63 | 61 | 9/ |

22(7) GAME 7

| | | |
|---|---|---|
| 72 | 61 | 62 |
| 71 | 8/ | 6/ |
| 63 | 81 | X |

22(8) GAME 8

| | | |
|---|---|---|
| 6/ | X | 7/ |
| 61 | 71 | 9/ |
| 72 | 62 | 63 |

Control # 456

*Fig. 4B*

Bowler Name John Benko

Game # 7

H Game

52

| | | |
|---|---|---|
| 8/ | 72 | X |
| 62 | 9/ | 71 |
| 61 | 63 | 81 |

I Game

54

| | | |
|---|---|---|
| 81 | 62 | 8/ |
| 63 | 9/ | 72 |
| 7/ | X | 61 |

16 Frame Fill-All

56

| | | | |
|---|---|---|---|
| 54 | 62 | 5/ | 63 |
| X | 9/ | 71 | 52 |
| 53 | 61 | 8/ | 7/ |
| 72 | 81 | 6/ | 71 |

Perimeter

58

| | | |
|---|---|---|
| 63 | 61 | 7/ |
| X | 6/ | 72 |
| 9/ | 71 | 8/ |

9 Frame Fill-All

60

| | | |
|---|---|---|
| 6/ | 71 | 9/ |
| 61 | 7/ | 81 |
| X | 62 | 8/ |

Control # 473

*Fig. 4C*

Bowler Name *John Benko* Game # 7

Top 2 Rows/Bottom 2 Rows

| | | |
|---|---|---|
| 7/ | 62 | 9/ |
| 8/ | 71 | 81 |
| 72 | 63 | X |

62

X Game

| | | |
|---|---|---|
| 9/ | 71 | 6/ |
| 72 | 62 | 63 |
| X | 81 | 61 |

64

L Game

| | | |
|---|---|---|
| 6/ | 81 | 8/ |
| 53 | 71 | 63 |
| 61 | 9/ | 62 |

66

C Game

| | | |
|---|---|---|
| 71 | 81 | 8/ |
| 72 | 8/ | 6/ |
| 9/ | 63 | X |

68

T Game

| | | |
|---|---|---|
| 61 | 72 | 8/ |
| 62 | 71 | 81 |
| 63 | 7/ | 9/ |

70

Control # *500*

Bowler Name John Benko

Game # 7

Get To The Point

Control # 503

BOWLING GAME USING SETS OF PREDETERMINED PIN FALL OBJECTIVES

FIELD OF THE INVENTION

This invention relates to games of skill, and more particularly to games in which a player rolls a ball to knock down objects such as pins. Still more specifically, the present invention relates to bowling games in which the bowler attempts to bowl sequences of predetermined pin combinations.

BACKGROUND AND SUMMARY OF THE INVENTION

Bowling is a very popular pastime in the United States and throughout the world. Professional bowlers compete for large purses, and many people enjoy watching people with great skill bowl on television or in person. Countless amateur bowlers join bowling leagues and compete in weekly tournaments against other teams. Casual bowlers enjoy rainy Saturday afternoons bowling with friends or family.

To be a good bowler requires a combination of talent, skill and experience. The professional bowler has spent years perfecting his or her technique, and may practice daily to more finely hone his or her skills. Serious amateur bowlers may play in leagues once or twice a week, and may also practice on their own. But people who bowl only occasionally for fun cannot maintain the skill level of the more serious bowler. Because of the way bowling is scored, less experienced bowlers can be disappointed when they compete against more skilled bowlers.

For example, consider a game in which an experienced amateur bowler competes against a less experienced bowler. The skilled bowler may roll strikes (i.e., knock down all of the pins with one ball) during many or most of the frames of a standard ten-frame bowling game. In the occasional frame when the experienced bowler does not roll a strike, he or she is likely to get a spare (i.e., all pins remaining after the first ball are knocked down with the second ball of a standard frame so that no pins are left standing at the end of the frame). The inexperienced bowler, on the other hand, may be as likely to roll a gutter ball as a spare or a strike. The inexperienced bowler may get an occasional strike or a spare, but in most frames he or she will knock down only some (and not all) of the pins. Because of the way strikes and spares are weighted under standard bowling scoring rules, the experienced bowler's score may be twice (or more) the score of the inexperienced bowler.

In tournament play, less experienced bowlers are given handicaps to help equalize effective scores despite great disparity in skill levels. Under the handicap system, experienced bowlers effectively "give" the less experienced bowler some number of points at the beginning of the game. For example, a less experienced bowler with a 35 handicap will be given a bowling score of 150 when he or she bowls 115. The use of a handicap helps to equalize competition and keep tournaments interesting for all—even though bowlers of different experience and skill levels are competing against one another.

Unfortunately, handicaps do not necessarily guarantee that each game will be interesting. For example, anyone who has watched an amateur bowling tournament appreciates that by the third or fourth frame of a standard 10-frame game, most of the participants have no chance of winning and start using the remaining frames for practice. In highly competitive tournaments, bowling a low score on the initial frames of the tournament effectively takes the bowler out of the running to win the tournament. This can cause some bowlers to lose interest—especially if they are having an "off night" or are out of practice.

Bowling games using non-standard scoring techniques and/or objectives are known. As one example, bowlers occasionally play the game of "low ball." The objective of the "low ball" game is to knock down the fewest number of pins without rolling a gutter ball. In another bowling variation called "odd ball," the bowler scores only if he knocks down an odd number of pins. Experience bowlers know many such variants of the basic bowling game, and may occasionally play them for a change of pace or as a way to practice particular aspects of their technique. However, such variants are typically not used in tournament play, and may have only limited interest to the less experienced bowler.

Operators of bowling centers are constantly looking for ways to interest broader segments of the population in bowling. People who operate bowling centers want to ensure that the bowling experience is interesting and exciting for their customers. Increased excitement makes the bowling experience more fun and enjoyable, generating more repeat business for the bowling center. More people coming into the bowling center to bowl means increased income to the bowling center operator.

The present invention provides a new approach to bowling that maintains a high level of player fun and excitement while offering the challenge of a game of strategy and skill and providing frequent winners. In accordance with one aspect of the present invention, the player attempts to bowl sets of predetermined pin fall objectives. In one specific example, each predetermined pin fall objective may comprise a pin fall combination, e.g., the number of pins the player knocks down on each of two successive rolls of the bowling ball. For example, one predetermined pin fall combination might be "71"—meaning the player is to knock down seven pins with the first ball and one additional pin with the second ball (leaving 2 pins standing at the end of the frame). Another predetermined pin fall combination might be a strike ("X")—in which all ten pins are knocked down with the first ball and there is no need to roll a second ball in the frame.

In accordance with a more detailed aspect provided by the present invention, predetermined pin fall counts or combinations may be visually recorded within a scoring grid of cells. The grid thus defines a set of predetermined pin fall counts or combinations. In one illustrative example., a three by three square scoring grid comprising nine cells may be used. A predetermined pin fall combination is recorded in each cell of the grid. In one example, the first player who success fully bowls any one of certain subsets of the nine predetermined pin fall combinations in the set (e.g., three cells aligned horizontally, vertically or diagonally or the four corner cells) wins the game.

Thus, the present invention provides a game of skill wherein the quantity of pins the bowler knocks down with each roll of the bowling ball is compared with a subset of a predetermined pattern for a possible match; and the outcome of the game is determined by the attainment, through the skill of the bowler in knocking down certain quantities of pins with the bowling ball, of a combination of more than one subset match such that the combination establishes a particular arrangement according to predetermined rules.

In one example, all players play the same scoring grid in a synchronized manner. However, each player can choose any of several different subsets of predetermined pin fall combinations to try for. In one example, the number of predetermined pin fall combinations in the subset is less than the number of pin fall combinations in the set. For any given game, there may be a number of different winning pin fall combination subsets. The player may choose which subset he or she is trying for—and the order of the pin fall combinations he or she bowls.

In the preferred embodiment, the number of pins that must be knocked down to meet any pin fall objective is ten or less—making it possible to meet the pin fall objective with the two balls and ten pins of the standard bowling protocol and configuration. Such bowling games provided in accordance with this invention are thus fully compatible with conventional automatic bowling equipment such as, for example, bowling lane pin clearing equipment that clears the lane of all knocked clown pins after each ball roll, and resets the pins into the starting configuration after the player has rolled two successive balls.

In one example implementation, paper scoring sheets may be used to play the bowling games. In accordance with another aspect provided by this invention, in one preferred embodiment, scoring is performed automatically using a computerized automatic bowling scoring system. In this computerized embodiment, grids of predetermined pin fall objectives are automatically displayed on a visual display such as a video monitor. As bowlers successfully bowl to match cells in the grid, the computer automatically changes the appearance of the grid display to reflect the bowler's success. For example, the computerized bowling system might cause the cell(s) the bowler has already matched to flash or be displayed in a different color. Upon matching a predetermined subset of cells defined by the grid, that subset may flash or change color to indicate that the bowler has successfully completed the game. In group bowling, the first person to complete the game wins. New games are thus begun every few frames—providing frequent winners and a high interest and excitement level.

BRIEF DESCRIPTION OF THE DRAWINGS

These and other features and advantages provided in accordance with the invention may be better and more completely understood by referring to the following detailed description of presently preferred exemplary embodiment in connection with the drawings, of which:

FIGS. 4A–4D show example scoring grids and sheets;

DETAILED DESCRIPTION OF PRESENTLY PREFERRED EXAMPLE EMBODIMENTS

Figure 1:
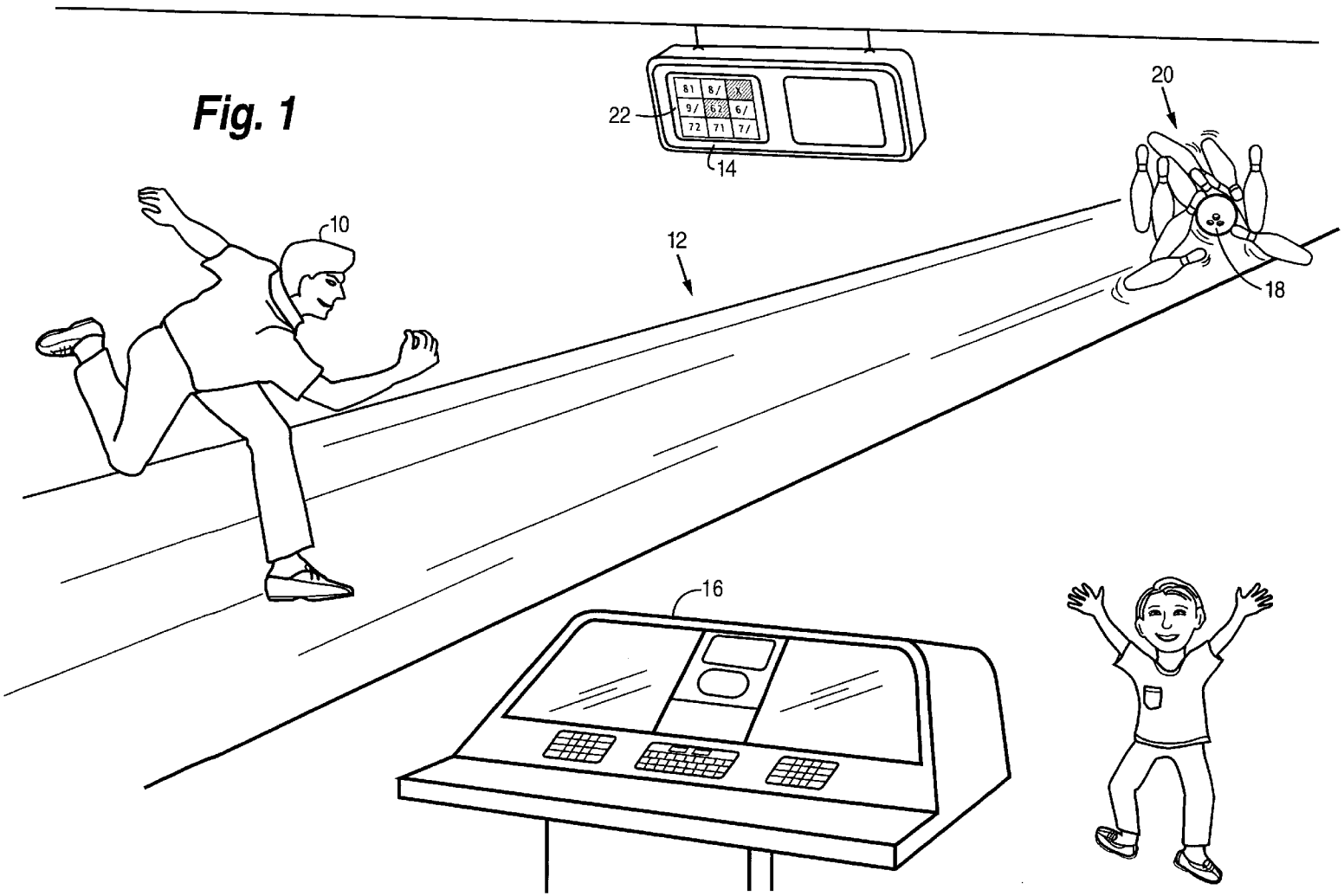
FIG. 1 is an example of a bowler playing a bowling game provided in accordance with the invention.

FIG. 1 shows an example of a bowler 10 bowling a bowling game provided in accordance with the present invention. In the FIG. 1 example, bowler 10 is bowling on a computerized bowling lane 12 including a video display 14 and a control console 16 The bowler 10 rolls bowling balls 18 down bowling lane 12 in an attempt to knock down predetermined numbers of bowling pins 20.

Unlike a conventional bowling game in which the object is to knock down all or as many pins as possible, the bowling game provided in accordance with this invention has as its objective to knock down a predetermined number of pins ("pin fall count") with each ball. While this predetermined number can be all the pins in some instances, it is generally less than all the pins.

To provide a level of strategy not available with other bowling games, games provided in accordance with the present invention offer bowler 10 a number of different ways to win. In this example, the video display 14 displays a score grid 22 that sets forth various different sets of pin fall counts. Bowling any of these sets of pin fall counts will satisfy the objective of the game.

Figure 2:
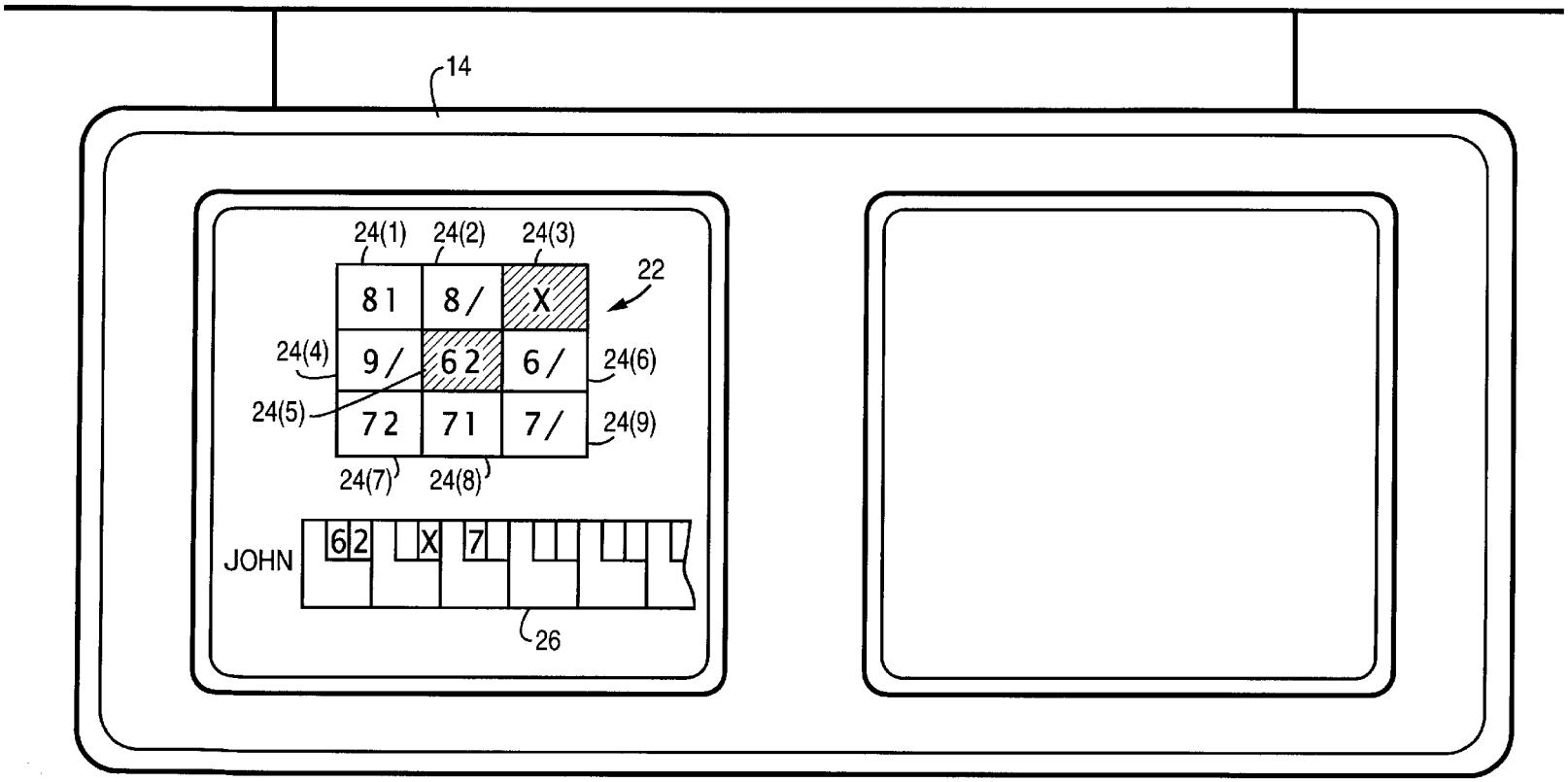
FIG. 2 shows an example display provided in accordance with one embodiment of this invention.

FIG. 2 shows a more detailed view of example video display 14 and example displayed score grid 22. As shown in the FIG. 2 example, the example score grid 22 comprises a square matrix of nine cells 24. In this example, the grid 22 is laid out as a square matrix three cells wide by three cells high. To win the game, the bowler 10 must match three cells aligned horizontally, vertically or diagonally—or the four corner cells. If multiple players are playing, the player who matches any one of these patterns rolling the fewest frames wins the game.

As shown on the display 14 shown in example FIG. 2, scoring grid cells 24 in this example each contain a pin fall combination comprising two pin fall counts: the first pin fall count is the number of pins to be knocked down by the first ball of a standard bowling frame, and the second pin fall count is the number of additional pins to be knocked down by the second ball of that same frame. For example, cell 24(1) represents a bowling frame in which bowler 10 is to knock down eight pins with his first ball and one additional pin with his second ball—leaving one pin standing at the end of the frame.

In this example, most cells 24 represent a two-ball pin fall combination. However, cell 24(3) requires bowler 10 to bowl a strike or "X" with his first ball, knocking down all ten pins and leaving none to knock down with a second ball. Moreover, in this example, some cells 24 require the player to knock down all ten pins, but other cells do not. For example, cells 24(2), 24(4), 24(3) and 24(9) in this example require bowler 10 to knock down all ten pins by the end of the frame. However, all remaining cells 24 require the bowler 10 to leave at least one pin standing.

In accordance with one aspect of the invention, not all possible pin fall counts or combinations are used. For example, in at least one variation provided by the present invention, no pin fall combination requires the player to knock down two or four pins on the first ball. It is very difficult to knock down only two or four of the ten bowling pins with one ball. It is easier for most bowlers of any experience level to knock down more than half of the ten pins with the first ball. Accordingly, one bowling game variation provided in accordance with this invention may use mostly or exclusively the following predetermined pin fall combinations:

TABLE I

| Pins Knocked Down on First Ball | Additional Pins Knocked Down on Second Ball |
|---|---|
| 6 | 1 |
| 6 | 2 |
| 6 | 3 |
| 6 | 4 (/) |
| 7 | 1 |
| 7 | 2 |
| 7 | 3 (/) |
| 8 | 1 |
| 8 | 2 (/) |
| 9 | 1 (/) |
| X | — |

The following additional pin fall combinations can be used for other variations, with or without some or all of the pin fall combinations set forth above:

TABLE II

| Pins Knocked Down on First Ball | Additional Pins Knocked Down on Second Ball |
|---|---|
| 1 | 1 |
| 1 | 7 |
| 1 | 8 |
| 1 | 9 (/) |
| 3 | 5 |
| 3 | 6 |
| 3 | 7 (/) |
| 5 | 1 |
| 5 | 2 |
| 5 | 3 |
| 5 | 4 |
| 5 | 5 (/) |

Note than pin fall combinations having a "0" as a first or second value are generally disfavored because it is trivial to intentionally roll a gutter ball.

In the FIG. 2 example, scoring grid 22 defines eight different winning cell group combinations (for example, any three cells aligned horizontally, vertically or diagonally—or the four corner cells). Thus, in this particular example, bowler 10 can complete the objective of the game by bowling the pin fall combinations set forth in any of the following eight cell groups or subsets (in any order) defined by score grid 22:

cell 24(1), cell 24(2), cell 24(3), or
cell 24(4), cell 24(5), cell 24(6), or
cell 24(7), cell 24(8), cell 24(9), or
cell 24(1), cell 24(4), cell 24(7), or
cell 24(2), cell 24(5), cell 24(8), or
cell 24(3), cell 24(6), cell 24(9), or
cell 24(1), cell 24(5), cell 24(9), or
cell 24(1), cell 24(3), cell 24(7), cell 24(9).

Figure 4D:
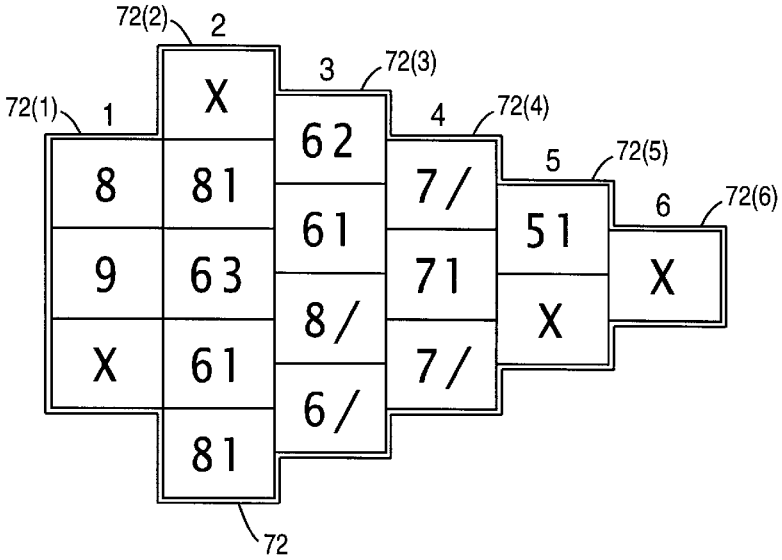

Other score grid patterns and/or configurations are possible (see FIGS. 4B–4D, for example).

The FIG. 2 example display 14 shows the display of a standard bowling frame score sheet 26 in addition to displaying grid 22. Optionally displaying the standard bowling score sheet 26 can help bowler 10 keep track of what he has bowled. However, in this particular embodiment, the only frames of the standard bowling score sheet 26 that "count" are those frames that provide a previously unmatched predetermined pin fall combination set forth in grid 22.

In accordance with this example, display 14 automatically indicates which cells 24 the player has already successfully bowled by, for example, displaying the matched cells in a different color, filling those cells in with shading, flashing the cells, etc. Display 14 may provide some additional indication when bowler 10 bowls all cells 24 in a predetermined pattern defined by grid 22 to complete the game. For example, display 14 could flash the particular cells 24 the player has bowled, flash the entire display of matrix 22, superimpose words such as "win" on the display, make an announcement over a public address system, ring a bell, activate a siren, etc.

Example Illustrative Game Play

Figure 3A:
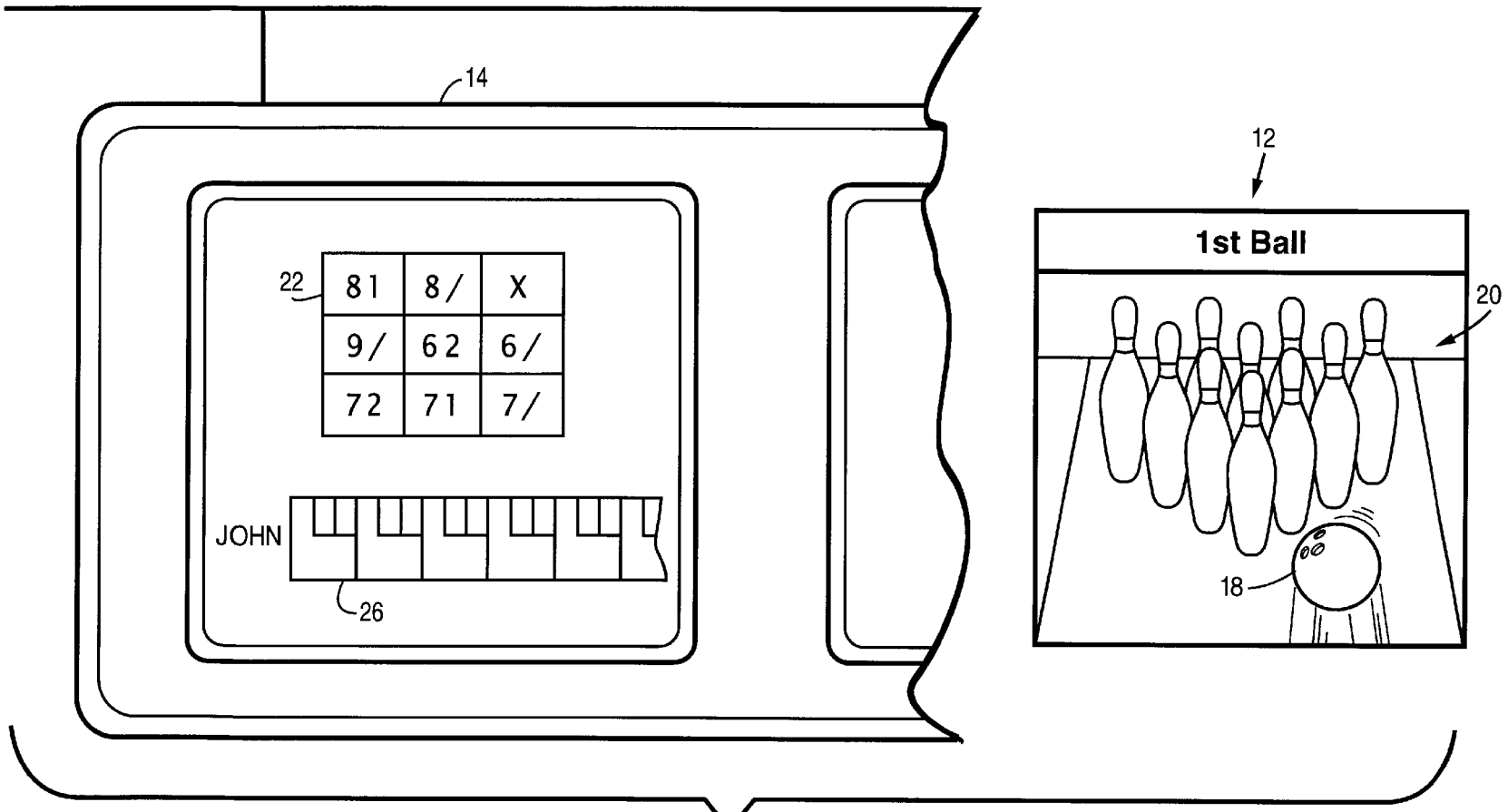
FIGS. 3A–F show one example illustration of a bowler winning an example illustrative game by bowling predetermined pin combinations.

For purposes of illustration, FIGS. 3A–3F show one illustrative example of game play provided in accordance with the present invention. FIG. 3A shows display 14 displaying an example scoring grid 22 at the beginning of the game, before bowler 10 has rolled his first ball. In this initial condition, score grid 22 sets forth the various pin combinations bowler 10 is to try for. This display thus challenges the bowler to bowl a predetermined subset of the set of pin fall combinations defined by the grid 22. If desired, a conventional bowling score sheet 26 may also be displayed.

Figure 3B:
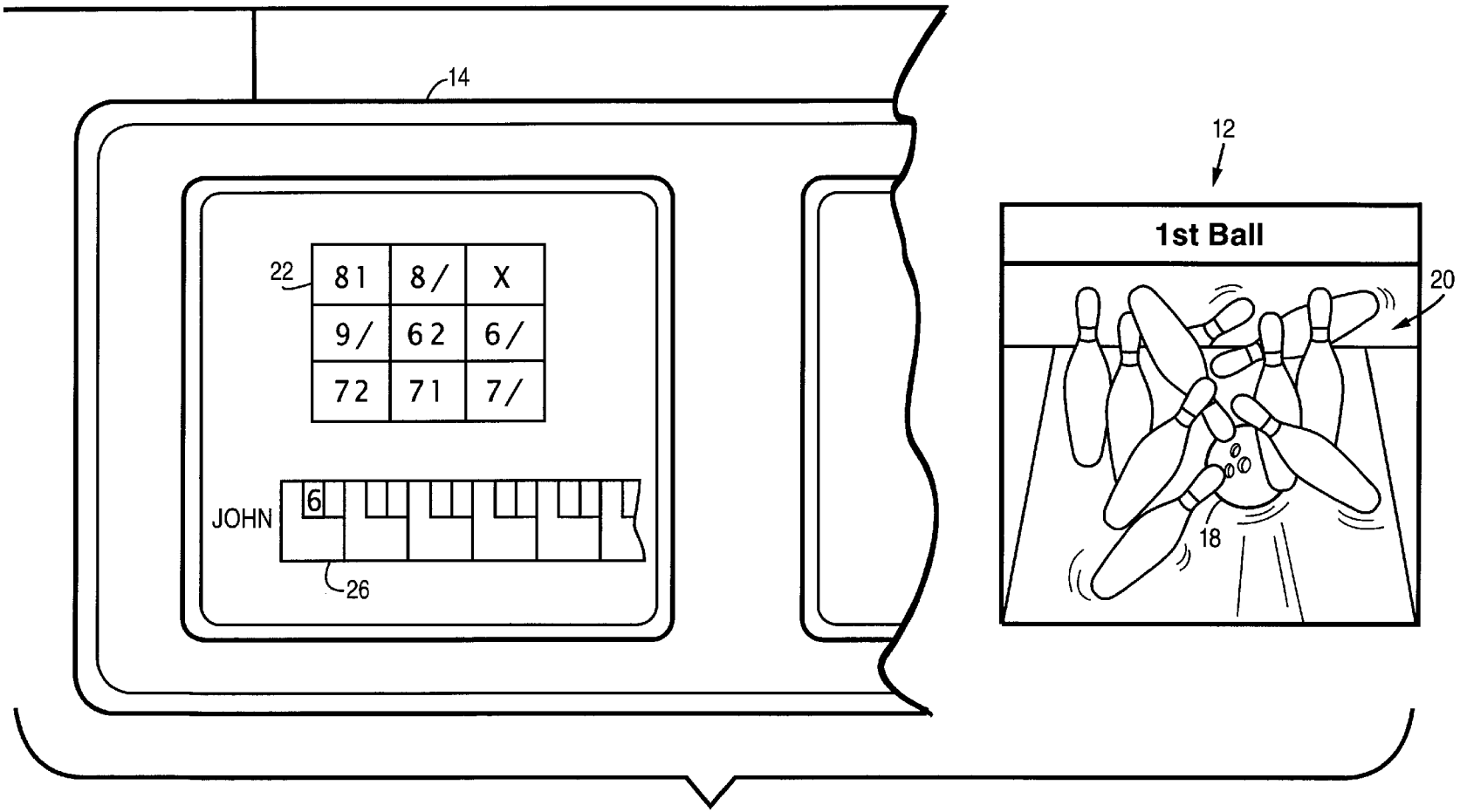
Figure 3C:
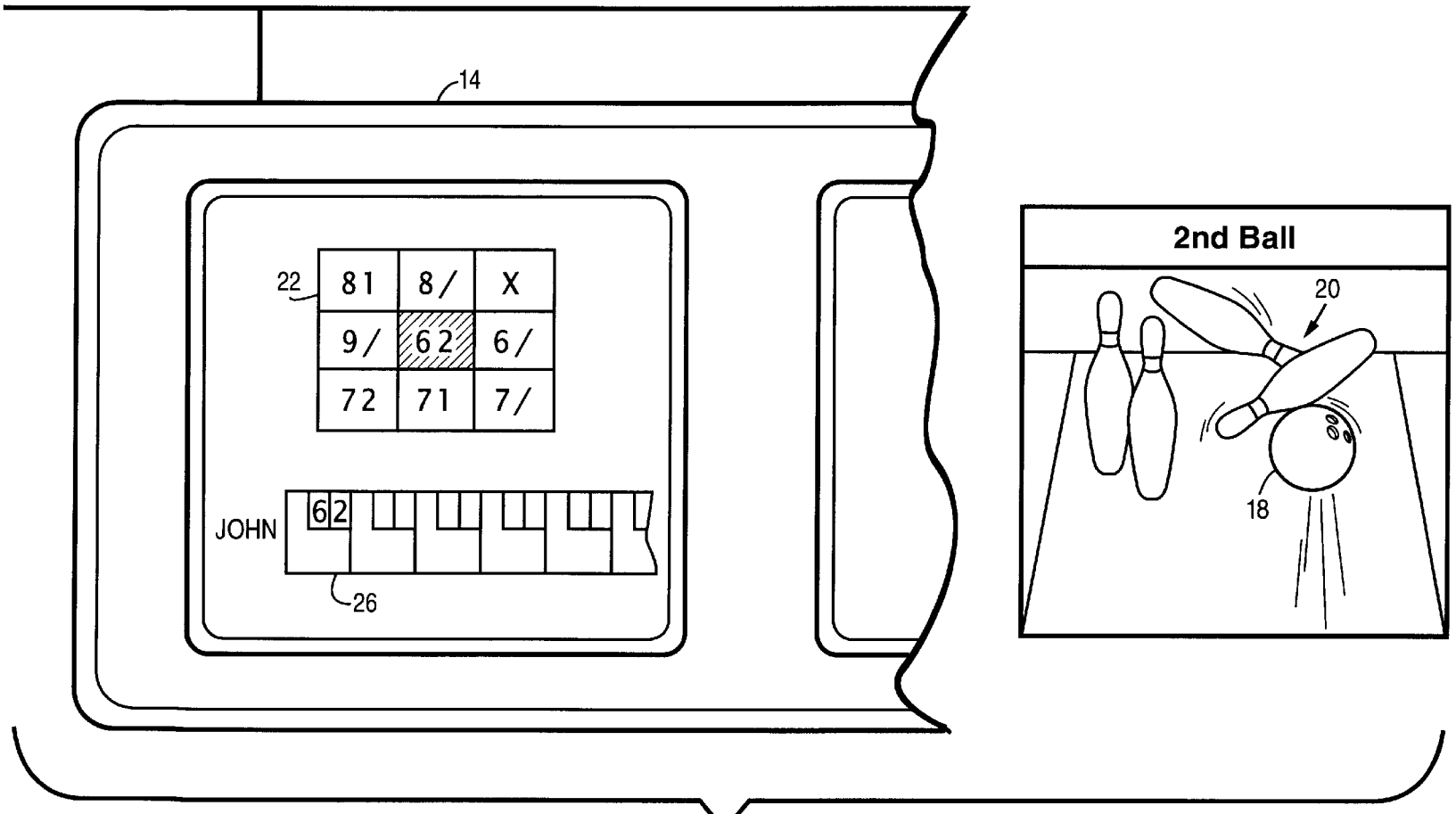
Figure 3D:
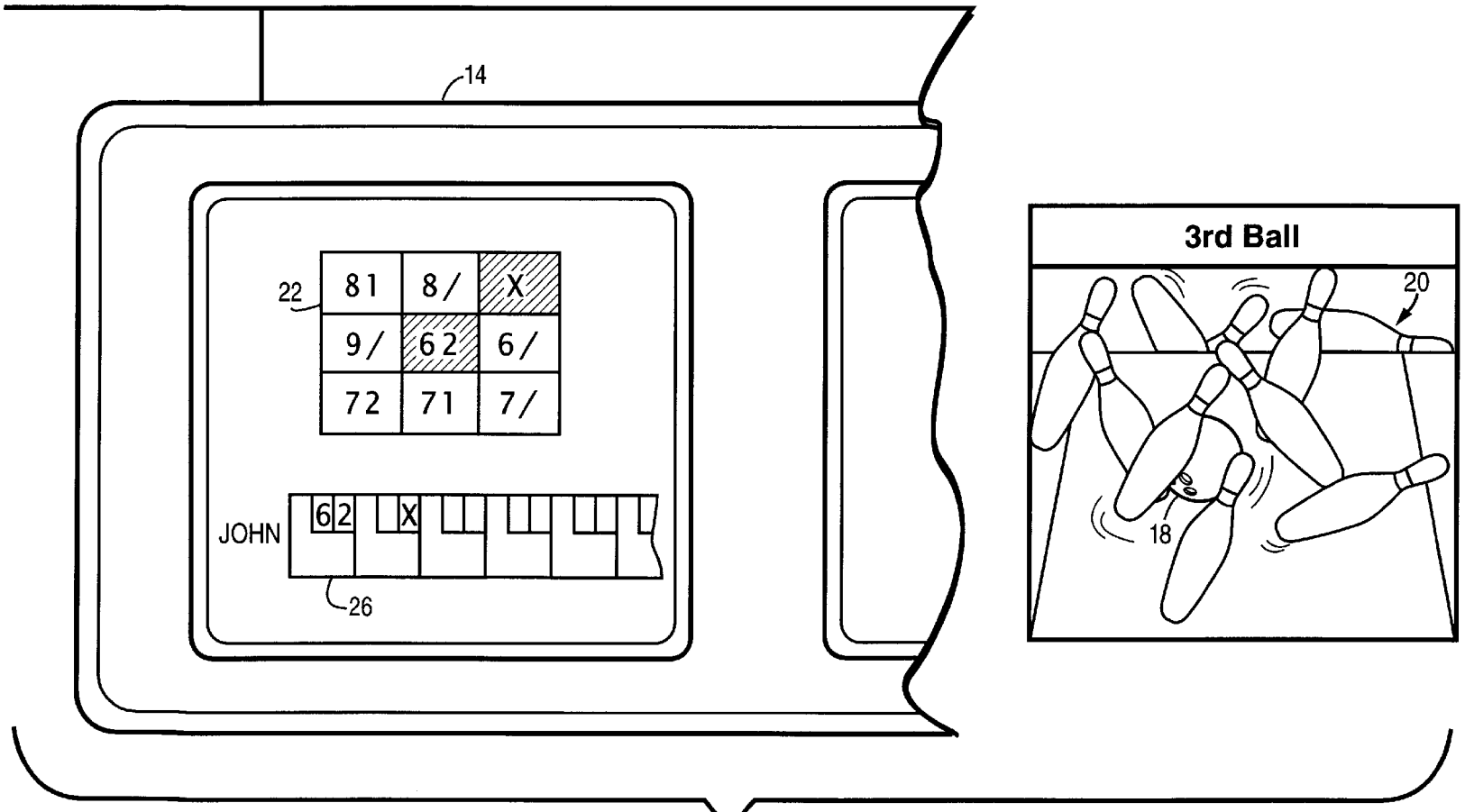

On the right-hand part of FIG. 3A, all ten pins 20 are standing in their initial condition, and bowler 10 has just rolled his first bowling ball 18 down lane 12 toward pins 20. FIG. 3B shows that the bowler 10's first ball 18 has knocked down six of the ten pins —leaving a "2—2" split, i.e., two pins on each side of lane 12. In a normal conventional bowling game, bowler 10 would try on his next ball to knock down as many of these four pins as possible to achieve a spare. In this example game provided in accordance with the present invention, in contrast, the bowler looks on score grid 22 to find cells that have the number "6" in the first pin fall count position—this "6" corresponding to the number of pins bowler 10 knocked down with his first ball.

In this particular instance, there are two score grid cells with the number "6" in its first position—the cell containing "6 2", and the cell containing "6/". Therefore, in this case, bowler 10 will not advance his position in the game if he knocks down no pins or three pins on his next roll, and will succeed in matching a cell of score grid 22 only if he knocks down either two pins or all four pins on his next roll. In this particular example, player 10 will not get any additional credit if he knocks down all four pins as opposed to only two pins—each of these two possibilities has the same effect of matching a single cell of score grid 22. However, as made more clear below, there may be strategic reasons for matching one cell as opposed to another.

Suppose bowler 10 in this case decides to make the easier goal (since knocking down two pins in this example allows the bowler to match a cell, and attempting the "spare" cell would be risky and perhaps result in no cell being matched) and knock down only two pins with his second ball 18. In the particular illustration shown in FIG. 3C, bowler 10 succeeds in knocking down these two pins, and therefore matches the center cell of grid 22 specifying the pin fall combination "6 2". Now that bowler 10 has matched the center cell, he can try for any other cell in the score grid 22 to advance his position in the game. In this example, matching the center cell is strategically advantageous because the center cell is part of a maximum number (i.e., four) of the winning patterns (subsets) defined by scoring grid 22. If, on the other hand, bowler 10 had knocked down all four pins on the last ball shown in FIG. 3C, and thus matched the "6 /" cell of example score grid 22, the bowler would be more limited in terms of the selecting and bowling additional two-pin combinations—since this "6 /" cell is part of only two winning patterns (subsets) defined by the score grid.

There is thus a significant amount of strategy involved in selecting which cells to match. This strategy interrelates with the skill of bowler 10. A very good bowler may be able to reliably bowl certain pin fall counts or combinations he or she tries for. However, a less experienced bowler need not try for the more difficult pin fall counts or combinations, but may instead attempt the easier ones. Although each bowler works from the same scoring grid 22 in this example, more and less experienced bowlers are on relatively equal footing because different players can select different subsets of pin fall combinations to win.

In group bowling, the next thing that happens after bowler 10 bowls his second ball is that all other players in the same lane 12 take their turn bowling a two-ball frame against their own score grid 22. As explained above, in one example embodiment, all bowlers 10 use the same score grid 22—but each bowler completes his or her copy of the score grid individually (i.e., balls rolled by one bowler do not count to match cells of another bowler's score grid).

When it is again bowler 10's turn, suppose he decides to try for the strike ("X") in the upper right-hand corner cell defined by scoring grid 22. In the illustrative example shown in FIG. 3D, bowler 10 rolls his third ball 18 and makes this strike. Display 14 indicates that bowler 10 has matched this new cell by, for example, shading the new cell, displaying it in a different color, etc.

Figure 3E:
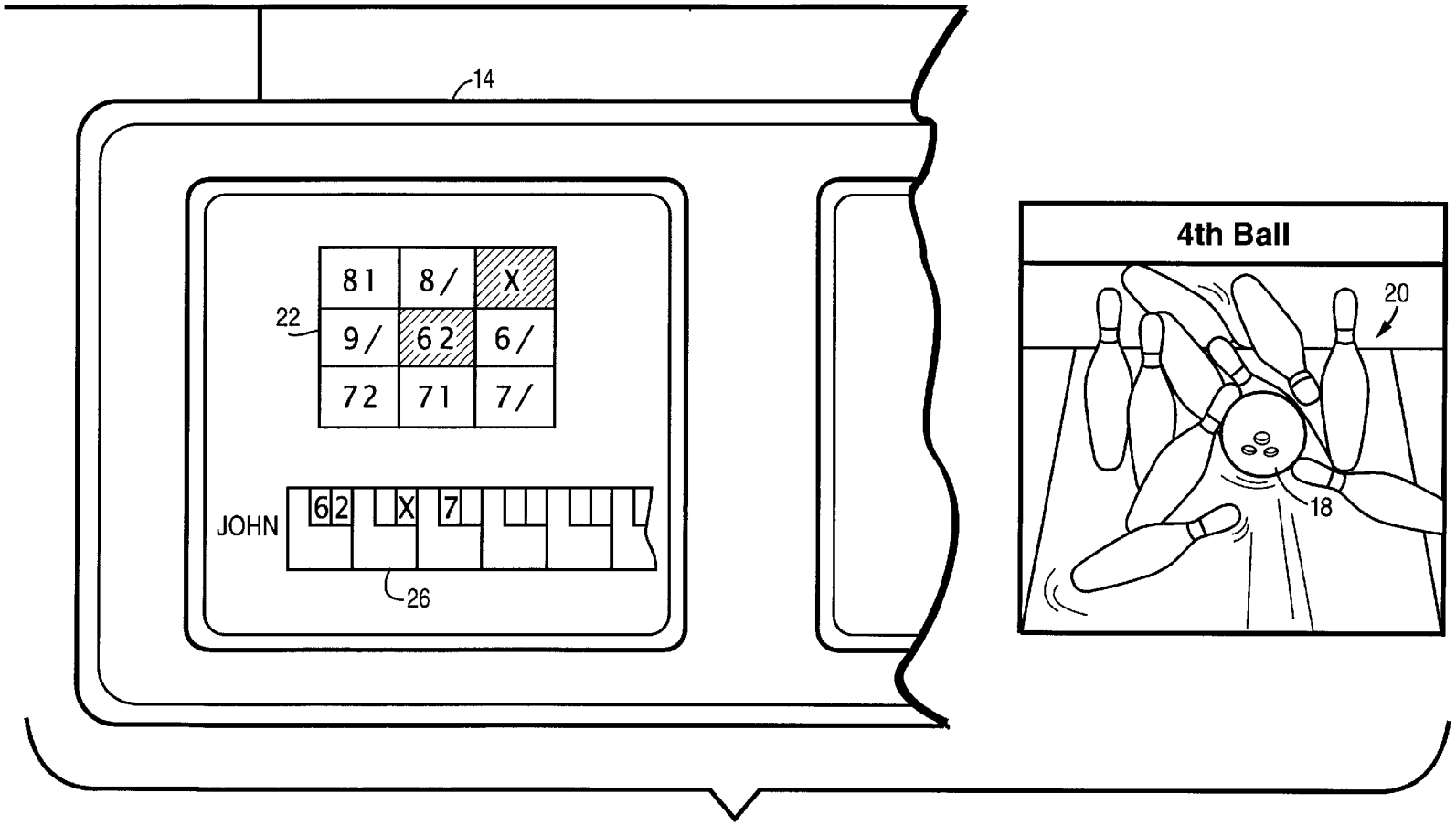

To win, bowler 10 now needs to match only the lower left-hand corner cell containing, in this example, the pin fall combination "7 2", to complete a winning grid pattern (subset). FIG. 3E shows an example of what happens when bowler 10 rolls his fourth ball and successfully knocks down seven pins (leaving 3 standing). In a conventional bowling game, bowler 10 wants each ball to knock down all ten pins. However, in this particular illustration, a strike will not advance bowler 10 in the game because example scoring grid 22 includes only one strike ("X") and bowler 10 has already matched that cell.

Figure 3F:
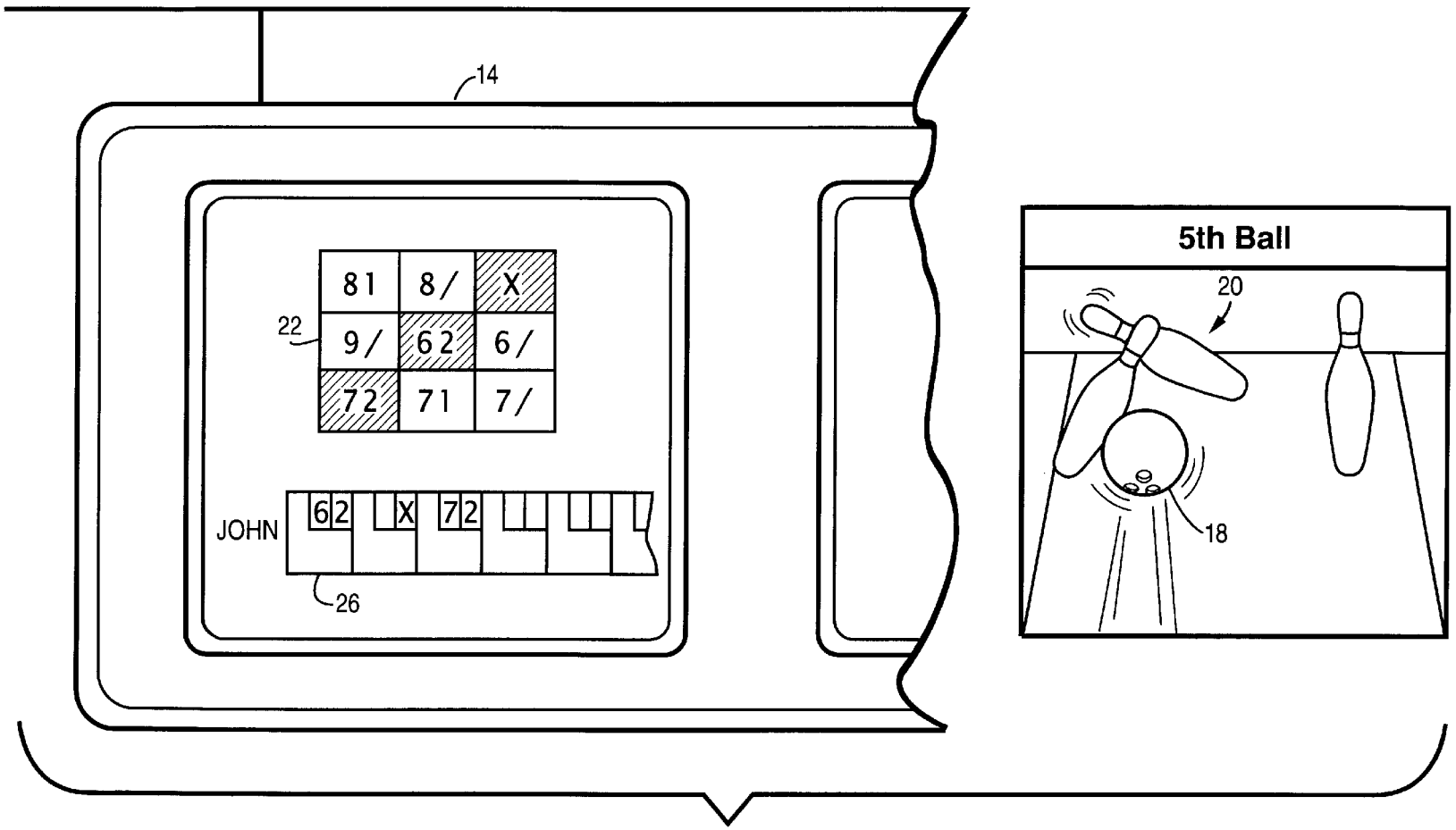

In order to now successfully match the lower left-hand corner cell, bowler 10 must knock down only two of the remaining three pins in this example. FIG. 3F shows that bowler 10 is successful in doing this—matching the lower left-hand corner cell and completing the game. In this particular example, it is likely that bowler 10 will have won the overall game by completing the game before anyone else, i.e., in the fewest number of frames. In synchronized tournament bowling, the first bowler to complete a winning pattern of grid 22 wins. If two or more bowlers complete a winning pattern on the same frame, they tie for that particular game.

Although the illustrative example shown in FIGS. 3A–3F shows bowler 10 completing the game in the fewest number of frames, it may take four or more frames before any bowler completes a grid 22. However, a high level of fun and excitement is maintained because the overall games are relatively short and a new challenge and starting point is presented at the end of each game, when a new scoring grid 22 with different pin fall combinations is distributed and/or activated. In addition, the strategy of playing this game is intense and challenging because different bowlers can fulfill the overall objective in different ways. Because each scoring grid 22 provides multiple subsets of predetermined pin combinations any of which will meet the objective of the game, different players can choose different subsets to win. Furthermore, players who choose the same subset of pin fill combinations may bowl the cells of the subset in different orders. For example, referring to the example shown in FIGS. 3A–3F, bowler 10 could have matched the three cells in any order (e.g., by bowling a strike first, then a "7 2", and then a "6 2"—or any other order). These variable factors add to the fun and excitement of the game.

FIG. 4A shows an example scoring sheet 30 including a number of different example three-by-three cell scoring grids 22 having different pin fall (combinations. These score grids 22 can be distributed by computer displays 14, as mentioned above—since the computer can maintain synchronization automatically between all players (i.e., all players begin a new game as soon as any player wins the previous game). The FIG. 4A example score sheet 30 could be used for solo bowling. If used for group bowling, all players in the group are provided with their own score sheet 20 which they complete as they bowl. In this example embodiment, all players work against the same score grid 22 in order to "level the playing field" and prevent one player from having an unfair advantage due to an "easier" score grid.

In tournament settings, a computer and/or a human "caller" using a public address system can ensure that all bowling in the tournament is synchronized. As soon as one bowler successfully completed a game, the computer can automatically detect this—or in another embodiment, the bowler would raise his hand and a human "runner" can check the bowler's score sheet against a record of what the bowler bowled in each frame. Upon finding a winner, the "caller" can instruct all tournament players to begin playing the next game with a new score grid 22.

The present invention is not limited to the three-by-three score grids 22 shown in FIG. 4A. For example, score grids of other configurations may be used to define predetermined pin fall combination sets and/or subsets. Moreover, is it not necessary to define predetermined pin fall combination sets and/or subsets using the particular patterns (i.e., cells aligned horizontally, vertically or diagonally) described above in connection with FIGS. 3A–3F.

FIGS. 4B–4D show additional, non-limiting examples as follows:

The FIG. 4B, three-by-three example "H Game" score grid 52 is "won" by matching the cells required to form the letter "H".

The FIG. 4B, three-by-three example "I Game" grid 54 is "won" by matching all cells required to form the letter "I".

The FIG. 4B, four-by-four example "16 Frame Fill-All" score grid 56 is "won" by matching all cells in the grid.

The FIG. 4B, three-by-three example "perimeter" score grid 58 is "won" by matching all cells around the grid perimeter (e.g., to form the letter "O").

The FIG. 4B, example three-by-three "9 Frame Fill-All" score grid 60 is "won" by matching all nine cells within the grid.

The FIG. 4C, example three-by-three score grid 62 is "won" by matching either the top two rows of the grid or the bottom two rows of the grid.

The FIG. 4C, example three-by-three "X Game" score grid 64 is "won" by matching the cells indicated to form a letter "X".

The FIG. 4C, example three-by-three "L Game" score grid 66 is "won" by matching the indicated cells to form a letter "L".

The FIG. 4C, example three-by-three "C Game" score grid 68 is "won" by matching the cells necessary to form the letter "C".

The FIG. 4C, example three-by-three "T Game" score grid 70 is "won" by matching the cells to form a "T".

The FIG. 4D, example "Get to the Point" score grid 72 of an arrow-shaped configuration is "won" by matching a cell in each column before moving on to the next column (i.e., this is an elimination game in which the bowler must match any cell from column 72(1) before moving on to column 72(2), etc.).

Patterns defined by other alpha numerics (e.g., "J" or "U" for a 3×3 cell grid) may also be used.

Optional Games

In accordance with another aspect provided by this invention, different score grids can be bowled simultaneously. For example, the score grids 22 shown in FIG. 4A may be the main grids being played. However, bowlers may be awarded bonuses by completing one or more alternative grids (e.g., the grids shown in FIGS. 4B, 4C, and/or 4D) in addition to (or instead of) the FIG. 4A grids. Thus, for example, a bowler could potentially not "win" any of the grids 22 shown in FIG. 4A, but instead win one or more of the grids shown in FIGS. 4B and 4C. Such "optional" or "alternate" games being carried on simultaneously in an overlaid fashion can add further excitement, interest and fun by providing still additional ways to win. Such alternate or optional games can also be played independently. Nearly everyone can be a winner irrespective of their overall bowling skill and experience—while still maintaining a strong relationship between the skill and strategy of individual bowlers and their abilities to win. Unlike certain games of chance, the example games provided in accordance with the present invention rely on the ability of a bowler to knock down desired pins. This is in direct contrast to games of chance in which winning is based on pure luck and has no relationship to any player action.

Example Non-Grid Embodiment

Figure 5:
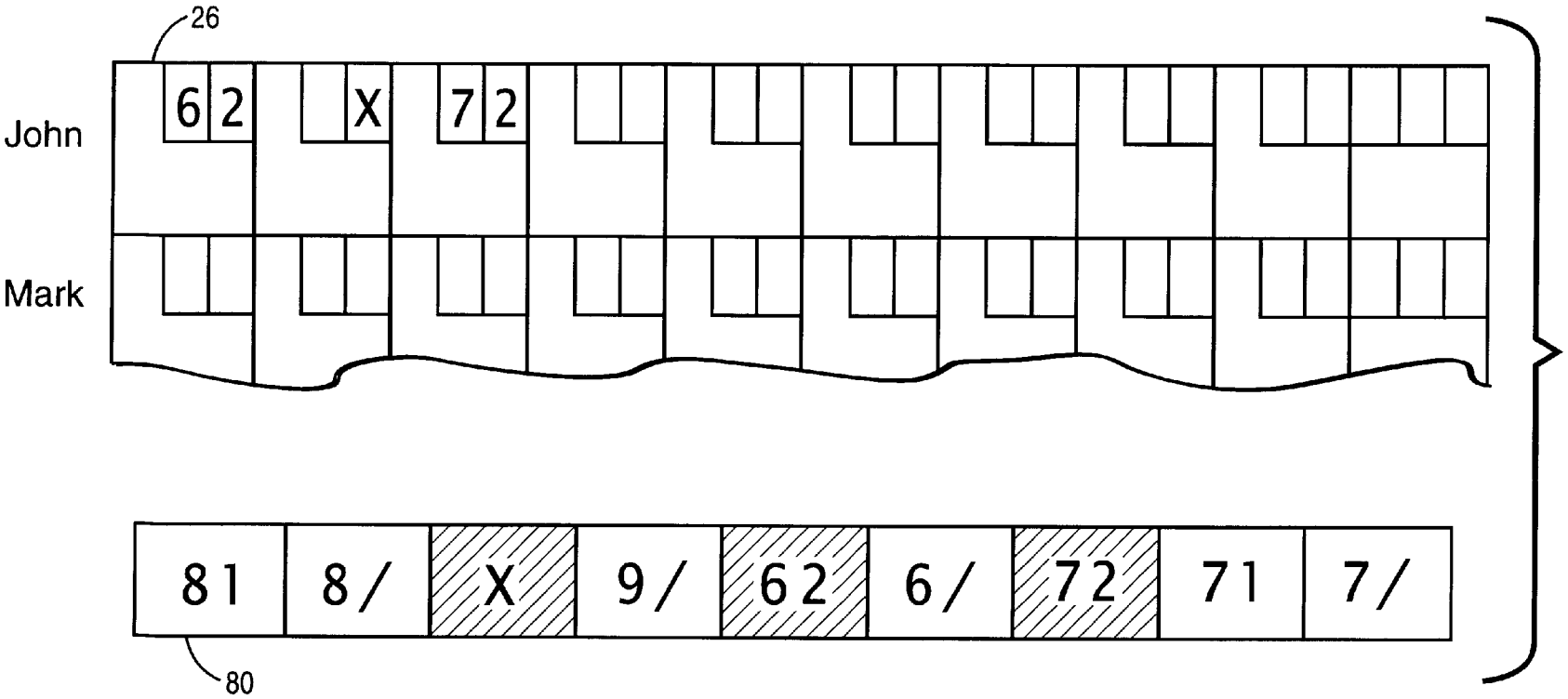
FIG. 5 shows an example alternate way to define sets of predetermined pin combinations.

FIG. 5 shows an additional variation in which the game provided in accordance with the present invention is played without score grids. In this example, the bowlers 10 are given a set 80 of predetermined pin fall combinations that can be bowled in any order to win the game. In accordance with one example, a bowler can win by bowling less than all predetermined pin fall combinations in the set 80. For example, a bowler 10 may win by bowling any three pin fall combinations specified within a set 80 of, for example, nine (or any other number of) pin fall combinations. In this example, a conventional bowling score sheet 26 may be used to keep track of the pin fall combinations the player has bowled. The FIG. 5 example reflects the same bowling results and the same game objectives as shown in FIGS. 3A–3F, but represents the objective pin fall combination sequences in a slightly different form. The scoring example shown in FIG. 5 may be kept on a manual score sheet, or preferably, scored by an automatic bowling scoring computer system.

Example Automatic Bowling Scoring System

Figure 6:
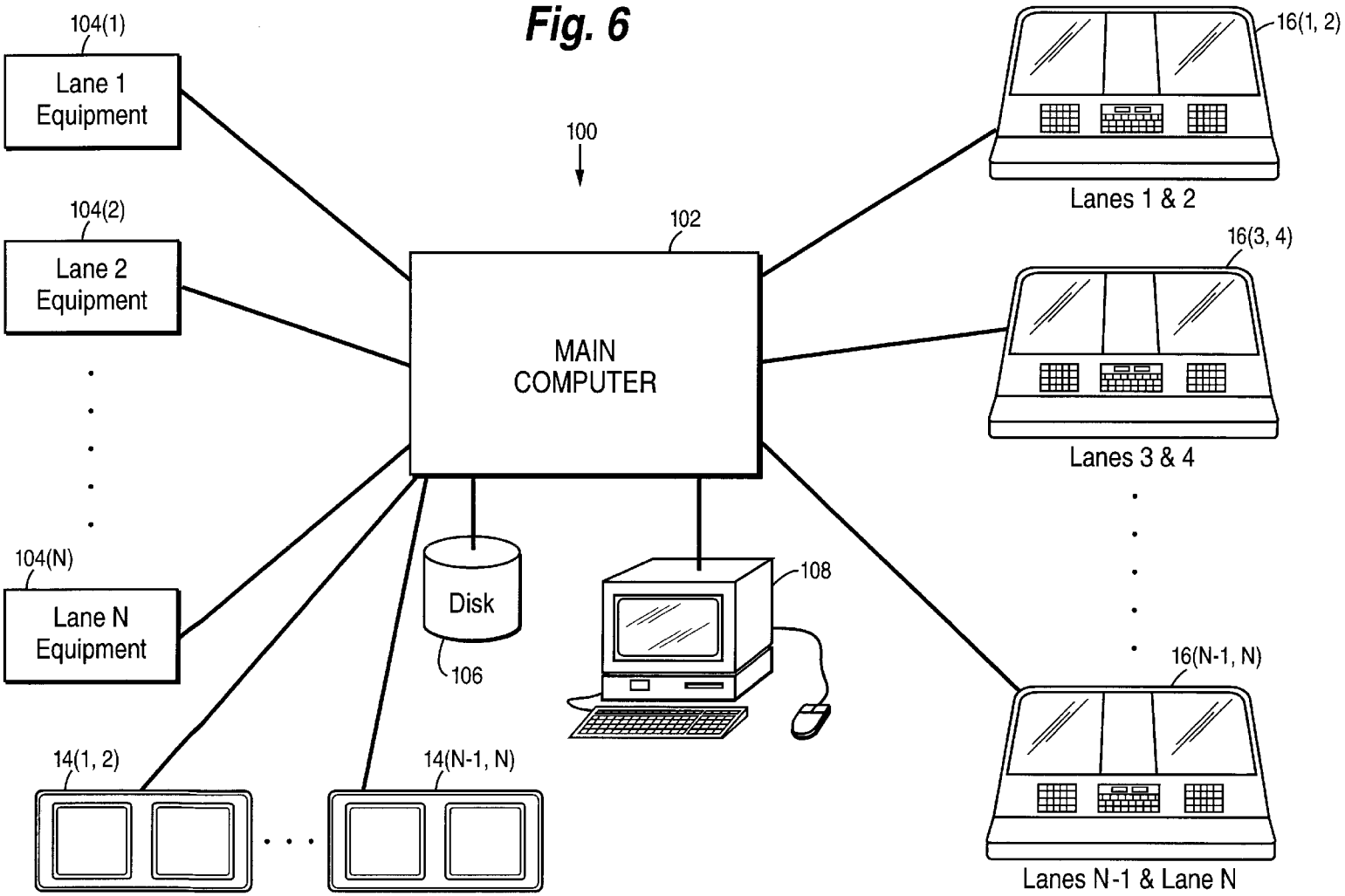
FIG. 6 shows an example automated bowling computer system providing game play in accordance with this invention.

FIG. 6 shows an example automatic bowling scoring system 100 that may be used in accordance with the present invention to automatically score bowling games. In this example, bowling computer system 100 includes a main computer 102 electronically connected to the various lane controllers 16 and lane displays 14. Additionally, main computer 102 is connected in this example to bowling lane equipment 104 which automatically senses when a bowling ball 18 has been bowled down a lane 12, automatically detects which bowling pins 20 have been knocked down by the bowling ball, automatically sweeps knocked down pins from the lane between the first and second balls of a frame, and automatically resets all pins to their initial positions at the end of a frame. Such automatic computer control by a main computer 102 of bowling lane equipment 104 is known by those of ordinary skill in the art, and many commercial bowling computer systems are readily available in the market to perform these various functions.

In accordance with the present invention, main computer 102 may include a magnetic disk 106 and/or other storage medium and a workstation 108 such as a personal computer. Disk 106 and workstation 108 are used in this example for the purpose of developing and coordinating games based onsets of predetermined pin fall combinations. In more detail, workstation 108 may be used to input (e.g., manually, from diskette or other storage media, etc.) scoring grids 22 and/or parameters for defining scoring grids. Such scoring grids 22 may be stored on disk 106. In response to commands inputted via workstation 108, main computer 102 may read scoring grids 22 from disk 106 and display them on displays 14 for use by bowlers. Main computer 102 may automatically monitor and tabulate the bowling results achieved by each bowler through use of lane equipment 104. Main computer 102 may automatically indicate to each bowler 10, via score grids 22 displayed on display 14, which cell or cells the bowlers have matched in the current game. Main computer 102 may automatically detect when a bowler has "won" a game by matching the necessary cells (i.e., bowling one of the several defined subsets of pin fall combinations). Main computer 102 can indicate via displays 14 that a bowler has won, and can display a new score grid 22 or other scoring information to all bowlers—thus synchronizing game play on a frame-by-frame basis.

Figure 7:
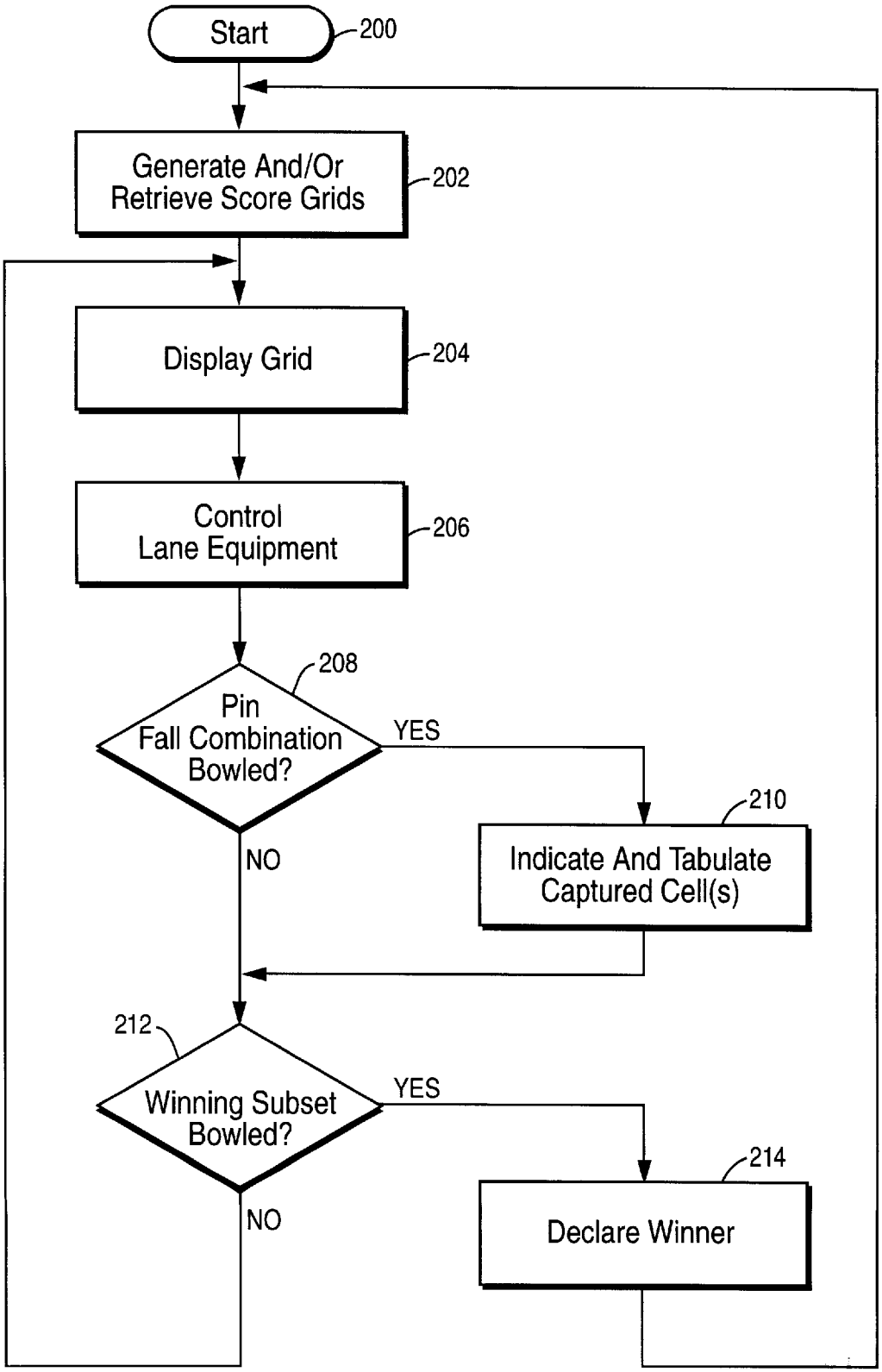
FIG. 7 shows a simplified flowchart of example program control steps performed by a bowling computer system.

FIG. 7 shows a simplified flowchart of steps that may be performed by main computer 102. Upon issuing a "start" command via workstation 108 (FIG. 7, block 200), main computer 102 may generate and/or retrieve one or more score grids 22 for use in game play (FIG. 7, block 202). In one example, computer 102 may randomly order the predetermined pin fall combinations set forth above in tables I and/or II to generate a new scoring grid 22. The operator of workstation 108 may influence the automatic score sheet generation process by specifying certain parameters such as, for example, whether a score sheet is to be "sasy" (i.e., use only the table 1 pin combinations) or "hard" (use some or mostly the table 2 pin combinations); whether a score sheet may contain duplicate cell entries; the size of the grid (e.g., three-by-three, four-by-four, etc.); the shape and configuration of the grid; and other factors. Main computer 102 may generate any number of unique score grids 22 based on these operator specified parameters. In another embodiment, a library of score grids 22 is generated beforehand and stored on disk 106 for retrieval by main computer 102 at the command of an operator via workstation 108. If multiple "optional game" score grids are used simultaneously, the computer 102 can analyze them to ensure that multiple games may not likely be won with a single shot (or this situation could be addressed by rules).

In response to additional operator commands via workstation 108, main computer 102 may display a particular score grid on each or any of displays 14 (FIG. 7, block 204). Main computer 102 may then control lane equipment 104 appropriately to allow bowlers 10 to begin bowling against the displayed score grid (FIG. 7, block 206). Main computer 102 may sense, with lane equipment 104, whether bowlers have bowled predetermined pin combinations of the displayed grid (FIG. 7, decision block 208). If a player has matched one of the displayed grid cells by bowling the specified predetermined pin fall combination, main computer 102 may tabulate this result in a database and indicate the matched cell on the bowler's version of the displayed grid (FIG. 7, block 210). Main computer 102 similarly detects, by analyzing the database at least once per frame, whether any bowler 10 has bowled one of the subsets of predetermined pin fall combinations required by the currently displayed score grid (FIG. 7, block 212). If no bowler has yet achieved this objective, main computer 102 repeats steps 204–212—allowing bowling to continue based on the same displayed grid ("no" exit to decision block 212, FIG. 7). As soon as main computer 102 detects that a bowler has bowled one of these subsets of predetermined pin fall combinations ("yes" exit to decision block 212), computer 102 declares (at the end of the current frame) a winner (FIG. 7, block 214), generates or retrieves a new score grid 22 (FIG. 7, block 202), and repeats blocks 204–214 with the new score grid.

More Detailed Scoring Rule Examples

The following is a more detailed example of an illustrative process for setting up and playing some example games provided in accordance with the present invention.

Eligibility

This Tournament is open to all bowlers, with the exception that PBA and LPBT members are not eligible. The House may declare Special Tournaments for a particular market segment such as, but not limited to, senior citizens; 189 average and under; etc. If such are declared, the above eligibility requirements still prevail and all entrants must meet the declared requirements of the Special Tournament.

General Rules

1. All entrants must fill out a tournament entry form.
2. All payments must be made at time of entry for the "Regular Game Score Sheet." Payments for the "Optional Game Score Sheet" (if chosen) and the "Mystery Number" (if chosen) must be made before the House announces that entries are closed.
3. All entrants must record their name (print first and last name) on their score sheets at the registration desk at the time of entry.
4. Lane assignments and the number of bowlers per lane are the choice of the tournament directors. Efforts will be made to place bowlers together who wish to bowl together.
5. All bowlers alternate lanes within their pair as in most tournaments.
6. The pace of this tournament is as slow as the slowest pair. Therefore, the tournament directors reserve the right within their sole judgment to move bowlers or split groups as they deem necessary to maintain a quality pace.
7. With the exception of the first three frames of the first regular game, all bowlers will complete each frame before the lead-off bowlers begin the next frame. The House caller will call the regular game finished if there are any verified winners or will instruct lead-off bowlers to begin the next frame.
8. Bowlers must request a tournament official to correct any errors recorded by the automatic scorers.
9. Any entrant who has scored either a regular game win or an optional game win, must declare out loud to a tournament official such win before the house caller begins the next frame. If an entrant fails to call out a win as stated above, then such entrant may do so in the next frame, but will be considered a winner in the frame called and will split any prize accordingly.
10. The tournament officials will verify all winners either at the scoring monitor or via the computer print out.

Regular Tournament Game

1. The number of regular games may vary per tournament. The House will declare how many regular games will be played for each tournament.
2. For each tournament, all entrants will compete with identical score sheets.
3. Each regular game will consist of a nine frame square, with each square containing a different first and second ball combination (a strike would be first ball only).
4. During each regular game, entrants may mark (score) each box on their score sheet in which they knocked down pins on first and second ball (first ball only for a strike) identical to what is shown in each box on their score sheet for that game. Bowlers are requested to use the reset button when their 2nd ball has no potential value. The tournament directors reserve the right to require this.
5. Scoring three frames in a row constitutes a Regular win (horizontal, vertical or diagonal). Four corners also counts as a Regular win.
6. From time to time, the house caller may designate any Regular game as a "Double" game. When such is declared, entrants must have two wins in that game in order to win. (As per rule 5 above.)
7. Once a regular tournament game has been won, then the winner receives, or the winners equally share, that games' prize. That game is declared over and the next game begins.

Optional Tournament Games

1. Only entrants who have entered the Regular Tournament Games are eligible to enter the Optional Tournament games.
2. The Optional Tournament games are "all or none," meaning an entrant must either enter all five games or not enter at all.
3. The Optional Tournament games consist of:
   A. The X Game
   B. The Perimeter Game (outside border)
   C. Top 2 rows or bottom two rows (fill either for a win)
   D. Nine (9) frame Fill-All
   E. Sixteen (16) frame Fill-All For each session, all entrants will compete with identical score sheets.

4. All five Optional Tournament games are played simultaneously with the Regular Tournament games. Each score bowled during the Regular Tournament games applies to all five of the Optional Tournament games.
5. Before bowling begins, the House will announce how many winning places will be allocated for each of the Optional games and what the prize is for each place.

As an example, if the House announces there will be two winning places per game, when an entrant wins a game they will receive first place prize for that game, and the next winner or winners will receive, or split, the prize for second place. Then that game will be closed. If two or more entrants win first place at the same time, then they split the entire prize for that game and then that game will be closed.

The Mystery Frame

1. Only entrants who have paid the Mystery Frame entry fee are eligible to win.
2. Before the Tournament begins, a Mystery Frame score will be randomly drawn by the caller (or the computer) and announced as that tournaments' Mystery Frame. The Mystery Frame will be a two ball pin combination or score.

3. To win the Mystery Frame prize, an entrant (or entrants) must win a Regular Tournament game by scoring the Mystery Frame for the win. The Mystery Frame does not apply to Optional Tournament Games.
4. When the Mystery Frame is won, the entire Mystery Frame prize is given to the winner, or shared equally among the winners. Once won, the Mystery Frame is closed for that Tournament.

"Get to the Point" Tournament Game

1. The "Get to the Point" Tournament game is an optional game that may be offered if lanes are available after completion of the Regular Tournament games.
2. If offered, any entrant who has entered that sessions' Regular Tournament is eligible.
3. Eligible entrants must pay the entry fee and obtain their score sheet before "Get to the Point" Tournament entries are declared closed.
4. The "Get to the Point" Tournament game is a six-frame elimination tournament. All entrants must complete each frame before a lead-off bowler begins the next frame. Entrants must precisely match any one of the box scores for that frame in order to proceed to the next frame. This game continues until all entrants are eliminated or until an entrant or entrants win by precisely matching the score in the last box (frame).
5. If the game is won, then the winning entrant or entrants will receive or share the prize.

While the invention has been described in connection with what is presently considered to be the most practical and preferred embodiment, variations are also possible. As one example, the above-described game could be implemented on a computer or video game playing device as a computer or a home or arcade video game. Instead of rolling a real bowling ball down a real bowling lane toward real bowling pins, the player could roll a virtual bowling ball down a virtual bowling lane toward virtual bowling pins. Details on how to program such computer-based bowling games are known to those skilled in the art. A user input device such as a hand controller, joy stick, keyboard, etc. could be used to specify the trajectory of the bowling ball. The computer could display this virtual bowling action, display the scoring grids or other arrangements as described above, and automatically keep score as described above. Accordingly, it is to be understood that the invention is not to be limited to the disclosed embodiment, but on the contrary, is intended to cover various modifications and equivalent arrangements included within the spirit and scope of the appended claims.

I claim:

1. A computerized bowling system for use with a bowling lane having plural pins, wherein a bowler rolls a ball down the lane to knock the pins down, the system comprising:

automatic bowling lane equipment for automatically handling the pins, the automatic bowling lane equipment including a sensor for automatically sensing which pins have been knocked down by each roll of the ball, the automatic bowling lane equipment resetting the lane after the bowler bowls a frame; and a computer arrangement coupled to the bowling lane equipment, the computer arrangement outputting a set of predetermined pin fall objectives, wherein the computer arrangement automatically indicates when a bowler has successfully bowled a predetermined pin fall objective in the set, and wherein the quantity of pins the bowler knocks down with each roll of the ball is compared with a subset of a predetermined pattern for a possible match; and further wherein the outcome of the game is determined by the attainment, through the skill of the bowler in knocking down certain quantities of pins, of a combination of more than one subset match such that the combination establishes a particular arrangement, according to predetermined rules.

2. A system as in claim 1 wherein computer arrangement provides a set of predetermined pin fall combinations including first and second pin fall counts, the first pin fall count specifying the number of pins knocked down by a first ball roll, the second pin fall count specifying the number of pins knocked down by a second ball roll.

3. A system as in claim 1 further including a display coupled to the computer arrangement, the display displaying the set of predetermined pin fall objectives provided by the computer arrangement.

4. A system as in claim 1 wherein the computer arrangement indicates, on the display, each predetermined pin fall combination in the set that the bowler has bowled in a game.

5. A system as in claim 1 wherein the display displays the set in a grid format.

6. A system as in claim 5 wherein the displayed grid format has plural cells, and each cell contains a pin fall combination.

7. A system as in claim 1 wherein at least some of the predetermined pin fall objectives in the set requiring the bowler to leave pins standing at the time the automatic bowling lane equipment resets the lane.

8. A computerized bowling system for use with a bowling lane having plural pins, wherein a bowler rolls a ball down the lane to knock the pins down, the system comprising:

automatic bowling lane equipment for automatically handling the pins, the automatic bowling lane equipment including sensing means for automatically sensing which pins have been knocked down by each roll of the ball, the automatic bowling lane equipment resetting the lane after the bowler bowls a frame; and a computer arrangement coupled to the bowling lane equipment, the computer arrangement outputting a set of predetermined pin fall objectives, wherein the computer arrangement automatically indicates when a bowler has successfully bowled a predetermined pin fall objective in the set, wherein the display displays the set in a grid format, the displayed grid format has plural cell, and each cell contains a pin fall combination, and wherein the displayed grid comprises nine cells arranged in a three cell by three cell matrix, and the computer arrangement determines when a bowler has successfully matched predetermined cell patterns in the matrix.

9. A computerized bowling system for use with a bowling lane having plural pins, wherein a bowler rolls a ball down the lane to knock the pins down, the system comprising:

automatic bowling lane equipment for automatically handling the pins, the automatic bowling lane equipment including sensing means for automatically sensing which pins have been knocked down by each roll of the ball, the automatic bowling lane equipment resetting the lane after the bowler bowls a frame; and a computer arrangement coupled to the bowling lane equipment, the computer arrangement outputting a set of predetermined pin fall objectives, wherein the computer arrangement automatically indicates when a bowler has successfully bowled a predetermined pin fall objective in the set, wherein the computer arrangement includes means for generating a cell matrix of at least three cells high by three cells wide, and wherein the computer arrangement fills at least some of the resulting nine cells with any of the following predetermined pin fall combinations:

6 pins on first ball, 1 pin on second ball (leaving 3 pins standing);

6 pins on first ball, 2 pins on second ball (leaving 2 pins standing);

6 pins on first ball, 3 pins on second ball (leaving 1 pin standing);

7 pins on first ball, 1 pin on second ball (leaving 2 pins standing);

7 pins on first ball, 2 pins on second ball (leaving 1 pin standing); and 8 pins on first ball, 1 pin on second ball (leaving 1 pin standing).

10. A system as in claim 1 wherein the computer arrangement includes means for synchronizing game play among plural bowlers.

11. A system as in claim 1 wherein the display, in use, displays the same set of pin fall objectives to each of plural bowlers competing in a game.

12. A system as in claim 1 wherein the computer arrangement, in use, provides a different set of predetermined pin fall objectives whenever the computer arrangement determines that a bowler has successfully bowled a subset of the set predetermined pin fall objectives.

13. A method of playing a game of skill by rolling a bowling ball down a bowling lane to knock down predetermined quantities of pins, said method comprising:

(a) generating a set of plural predetermined pin fall counts; and (b) establishing a least one bowler as a winner if the bowler successfully bowls at least a predetermined subset of the set of predetermined pin fall counts defining a predetermined pattern, wherein the pin fall count the bowler knocks down with each roll of the ball is compared with the predetermined subset for a possible match; and further wherein the outcome of the game is determined buy the attainment, through the skill of the bowler, of a combination of more than one subset match such that the combination establishes a particular arrangement, according to a predetermined set of rules.

14. A method as in claim 13 wherein the subset has the same number of pin fall counts as the set.

15. A method as in claim 13 wherein the subset has fewer pin fall counts than the set.

16. A method as in claim 13 wherein step (a) comprises randomly selecting the plural predetermined pin fall counts.

17. A method as in claim 13 wherein step (a) comprises selecting the set of predetermined pin fall counts from a pool of predetermined pin fall counts.

18. A method as in claim 13 wherein each pin fall count in the set comprises a pin fall combination comprising a first ball pin fall count and a second ball pin fall count.

19. A method as in claim 13 further including using bowling lane equipment to implement a bowling frame protocol that sweeps the lane of knocked down pins after each roll of the ball and resets the pins after a second ball roll.

20. A method as in claim 13 further including the step of communicating the set to at least one bowler.

21. A method as in claim 13 wherein the generating step (a) is performed automatically by a computer.

22. A method as in claim 13 wherein the generating step (a) includes the step of recording each of the plural pin fall counts within a different cell defined by a grid.

23. A method as in claim 13 further including displaying the set on a video monitor.

24. A method as in claim 13 wherein step (b) includes the step of determining whether the bowler has bowled any three predetermined pin counts in the set.

25. A method as in claim 13 wherein step (a) includes the step of recording each of the plural pin counts within a different cell defined by a 3 cell by 3 cell grid, and step (b) includes determining whether the bowler has matched each cell in at least one predetermined pattern on the grid.

26. A method as in claim 13 wherein the distributing step includes distributing at least one paper score sheet to the bowler.

27. A method as in claim 13 further including the step of distributing the set of predetermined pin fall counts to plural bowlers, and arranging for the plural bowlers to play in synchronism.

28. A method as in claim 13 wherein step (b) includes the steps of automatically sensing the pins the bowler knocks down on each bowling ball roll, automatically tabulating the sensed results in a database, and automatically analyzing the database and determining whether the bowler has bowled a subset of the predetermined pin fall counts in the set.

29. A method as in claim 13 further including resetting the bowling lane, and wherein at least some of the predetermined pin fall counts require the bowler to leave pins standing at the time the bowling lane is reset.

30. A method of playing a bowling game using a bowling lane having pins disposed at one end thereof, the bowling lane being adapted to carry a bowling ball to the lane end so the bowling ball can knock down the pins, the method comprising:

(a) providing a scoring grid including plural cells, each cell containing at least one value specifying the quantity of pins to be knocked down by at least one roll of the bowling ball, said scoring grid establishing a predetermined pattern for a possible match;

(b) challenging the bowler to roll the bowling ball to try to knock down the quantity of pins specified by the values contained within the plural cells;

(c) comparing the quantity of pins the bowler knocks down with each roll of the bowling ball with a subset of the predetermined pattern for a possible match; and (d) determining the outcome of the game by the attainment, through the skill of the bowler, of a combination of more than one subset match such that the combination establishes the predetermined pattern, according to a predetermined set of rules.

31. A method as in claim 30 further including the step of challenging the bowler to win the bowling game by matching the predetermined pattern of cells in a cell grid.

32. A method as in claim 30 wherein the pattern includes at least one of the following:

"I";

"C";

"H";

"O";

"X";

"L";

"J";

"T";

"U"; and all of the cells in the grid.

33. A method as in claim 30 wherein the pattern corresponds to at least one alpha numeric.

34. A method as in claim 30 wherein the pattern includes any three cells aligned vertically, horizontally, or diagonally.

35. A method as in claim 33 wherein the pattern includes four corner cells.

36. A method as in claim 30 wherein each cell of the scoring grid includes a further value specifying the number of pins to be knocked down by a second ball roll.

37. A method as in claim 30 wherein step (b) is performed by challenging the bowler to match any of plural predetermined patterns defined by the scoring grid.

38. A method as in claim 30 further including resetting the bowling lane, wherein at least some of the quantities of pins specified by the values contained within the plural cells require the bowler to leave pins standing at the time the lane is reset.

* * * * *